US009161114B2

(12) United States Patent
Bone et al.

(10) Patent No.: US 9,161,114 B2
(45) Date of Patent: Oct. 13, 2015

(54) EARMOLDS

(71) Applicant: TREEFROG DEVELOPMENTS, INC., San Diego, CA (US)

(72) Inventors: Brian C. Bone, San Diego, CA (US); Nicholas J. Murrells, San Diego, CA (US); Feng Feng, Sugar Land, TX (US)

(73) Assignee: TREEFROG DEVELOPMENTS, INC., San Diego, CA (US)

( * ) Notice: Subject to any disclaimer, the term of this patent is extended or adjusted under 35 U.S.C. 154(b) by 0 days.

(21) Appl. No.: 14/222,536

(22) Filed: Mar. 21, 2014

(65) Prior Publication Data

US 2014/0286515 A1 Sep. 25, 2014

Related U.S. Application Data

(60) Provisional application No. 61/804,605, filed on Mar. 22, 2013.

(51) Int. Cl.
*H04R 25/00* (2006.01)
*H04R 1/10* (2006.01)

(52) U.S. Cl.
CPC ..... *H04R 1/1016* (2013.01); *H04R 2460/17* (2013.01)

(58) Field of Classification Search
CPC ..... H04R 25/604; H04R 25/652; H04R 1/10; H04R 2460/09; H04R 2460/17
USPC ..... D14/223
See application file for complete search history.

(56) References Cited

U.S. PATENT DOCUMENTS

| | | | | |
|---|---|---|---|---|
| 4,683,587 | A | 7/1987 | Silverman | |
| 4,972,492 | A | 11/1990 | Tanaka et al. | |
| 5,092,458 | A | 3/1992 | Yokoyama | |
| 5,142,587 | A | 8/1992 | Kobayashi | |
| 5,544,253 | A | 8/1996 | Nagayoshi et al. | |
| 5,659,156 | A * | 8/1997 | Mauney et al. | 181/130 |
| 5,712,453 | A | 1/1998 | Bungardt et al. | |
| 5,953,435 | A | 9/1999 | Mullin et al. | |
| 6,122,388 | A * | 9/2000 | Feldman | 381/322 |
| 6,396,769 | B1 | 5/2002 | Polany | |
| 6,614,722 | B2 | 9/2003 | Polany et al. | |
| 6,690,807 | B1 * | 2/2004 | Meyer | 381/327 |
| 6,751,328 | B1 | 6/2004 | Lin | |
| 6,810,987 | B1 | 11/2004 | DeKalb | |
| 6,944,307 | B2 | 9/2005 | Berg | |
| 7,031,485 | B2 | 4/2006 | Webber et al. | |
| 7,068,803 | B2 | 6/2006 | Kuhlmann et al. | |
| 7,233,676 | B2 | 6/2007 | Bayer | |
| 7,263,032 | B2 | 8/2007 | Polany et al. | |
| 7,394,910 | B2 | 7/2008 | Smith et al. | |
| 7,412,068 | B2 | 8/2008 | Bayer | |
| 7,536,008 | B2 | 5/2009 | Howes et al. | |
| D618,218 | S | 6/2010 | Burgett et al. | |
| D618,219 | S | 6/2010 | Burgett et al. | |
| 7,778,435 | B2 | 8/2010 | Smith et al. | |
| 7,899,200 | B2 | 3/2011 | Karamuk et al. | |
| 7,916,884 | B2 | 3/2011 | Kah | |
| 8,031,894 | B2 | 10/2011 | Perkins et al. | |
| 8,111,861 | B2 | 2/2012 | Lowry | |

(Continued)

*Primary Examiner* — Tuan D Nguyen

(57) ABSTRACT

This disclosure relates generally to an apparatus for retaining an earpiece in the ear during physical movement and exercise. In various instances, the apparatus may include a thinned region a posterior arch and ribs to allow deformation of the earmold and facilitate securing of the earmold in the concha bowl of the ear.

18 Claims, 6 Drawing Sheets

(56) References Cited

U.S. PATENT DOCUMENTS

| | | | | |
|---|---|---|---|---|
| 8,121,325 | B2 | 2/2012 | Atamaniuk et al. | |
| D655,693 | S | 3/2012 | Silvestri et al. | |
| 8,130,942 | B2 | 3/2012 | Howes et al. | |
| 8,175,315 | B2 | 5/2012 | Tanaka et al. | |
| 8,249,287 | B2 | 8/2012 | Silvestri et al. | |
| 8,254,621 | B2 | 8/2012 | Silvestri et al. | |
| 8,311,253 | B2 | 11/2012 | Silvestri et al. | |
| 8,331,593 | B2 | 12/2012 | Slemming et al. | |
| D673,530 | S | 1/2013 | Feng et al. | |
| 8,731,228 | B2 | 5/2014 | Burgett et al. | |
| 2002/0009195 | A1 | 1/2002 | Schon | |
| 2005/0008180 | A1* | 1/2005 | Smith et al. | 381/328 |
| 2009/0226025 | A1* | 9/2009 | Howes et al. | 381/380 |
| 2010/0278364 | A1* | 11/2010 | Berg | 381/311 |
| 2011/0017620 | A1 | 1/2011 | Latchford et al. | |

* cited by examiner

EARMOLDS

FIELD

This disclosure claims priority from U.S. Provisional Application No. 61/804,605, filed Mar. 22, 2013, which is incorporated in its entirety herein by reference thereto.

This disclosure relates generally to an apparatus for retaining an earpiece in the ear of a user. The earmold may be configured as a separate cover or integrally molded to the earpiece.

BACKGROUND

Portable headphone speakers for listening to sound are in common use and can have a variety of configurations. For example, larger, heavier headphones may be circumaural ("full-size" headphones that encompass the ear) or supra-aural (typically having pads that press against the ear). Smaller, lighter-weight headphones/earphones, sometimes called "ear-fitting headphones" such as earbuds or in-ear headphones may be designed to fit within a portion of the ear. Such portable headphone speakers may be used alone, in combination with a microphone for use with a mobile communication device (e.g. a cell phone) or to amplify external sounds, as with a hearing aid. Small, ear-fitting headphones that fit in the concha bowl of the ear and direct sound into the ear canal, such as earbuds and earmolds, are preferred by some users due to their smaller size and weight relative to larger, heavier headphones that encompass the ear or press against the concha and/or pinna of the ear. The smaller, in-ear headphones or earbuds may be preferred in many instances for use during exercise or other physical activity, such as running or biking However, such activities commonly include forceful movements of the head or body that can jar small-size earpiece from the user's ear. It is desirable to have an earpiece or earmold associated with the headphone that retains the headphone in the ear while moving, and is comfortable to wear.

SUMMARY

An earpiece for transmitting sound from a headphone to an ear of a wearer is disclosed which includes an earmold for fitting within the concha cavum (concha bowl) of the typical wearer's ear. The earmold includes a main body having a shape substantially corresponding with the concha cavum and having a hollow sound channel therein. The hollow sound channel extends from an opening or inlet, configured to be proximate a sound producing element or transducer of the headphone when in use, to a sound channel output port configured to be positioned proximity to an inferior (lower) region of the concha cavum when used with the headphone and worn by the user, the sound channel thus conducting sound from the headphone to (or near) the user's ear canal at the inferior region of the concha cavum. The earmold further has a posterior arch extending out from a side of the earmold opposite the sound channel output port, the posterior arch oriented to correspond with and compress against an antihelix region of the concha cavum to maintain the earmold within the concha cavum of the ear of the wearer.

As used herein, the term "exterior side" refers to the portion of the earmold that faces outward, away from the ear, when mated with an earpiece and inserted into the concha bowl of the ear. Conversely, the term "interior side" refers to the portion of the earmold that faces inward, towards the ear, when mated with an earpiece and inserted into the concha bowl of the ear.

The term "about" as used herein in reference to quantitative measurements, refers to the indicated value plus or minus 10%.

The summary of the invention described above is non-limiting and other features and advantages of the invention will be apparent from the following detailed description of the invention, and from the claims.

DETAILED DESCRIPTION OF THE DISCLOSURE

The detailed description set forth below in connection with the appended drawings is intended as a description of exemplary embodiments of the present disclosure and is not intended to represent the only embodiments in which the present disclosure can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the disclosure. It will be apparent to those skilled in the art that the exemplary embodiments of the disclosure may be practiced without these specific details. In some instances, well-known structures and devices are shown in block diagram form in order to avoid obscuring the novelty of the exemplary embodiments presented herein.

The present disclosure is directed to an apparatus for more comfortably securing an earpiece in the concha cavum of a human ear, such that the earpiece is not easily shifted in position unintentionally during use, especially during vigorous physical activity such as jogging or biking, during which the ear may be subjected to movement which may otherwise jostle the earpiece from the ear. It is desirable to have an earpiece or earmold associated with the headphone that is comfortable to wear and can be used in a variety of differently-shaped ears while remaining securing retained in the ear even when the user's head, and thus ear, experiences forceful movement.

Figure 1:
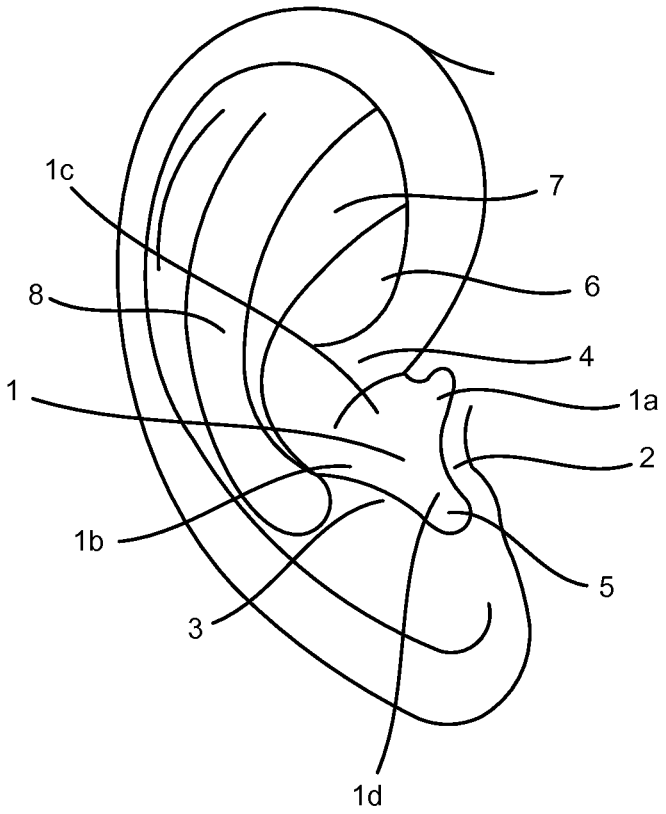
FIG. 1 shows certain external anatomical features of the human ear.

FIG. 1 depicts the exterior portion (or pina) of a human ear and some of its anatomic features. The concha cavum 1, or concha bowl, is framed by the tragus 2, antitragus 3, and crus of helix 4. In the context of this application, the concha bowl has four subregions, the anterior concha cavum 1*a*, the posterior concha cavum 1*b*, the superior concha cavum 1*c*, and the inferior concha cavum 1*d*. The intertragic notch 5 is a gap that lies between the tragus and antitragus. The concha cavum lies directly next to the ear canal (not shown). The concha cymba 6 lies above the crus of helix 4 and below the anterior crus 7 of the antihelix 8. While most human ears have these features, their exact dimensions and orientation vary significantly from person to person. Thus, it is difficult to provide a limited number of earmold sizes that are configured to fit in the concha cavum, are comfortable, and yet secure-fitting for many different people.

Figure 2A:
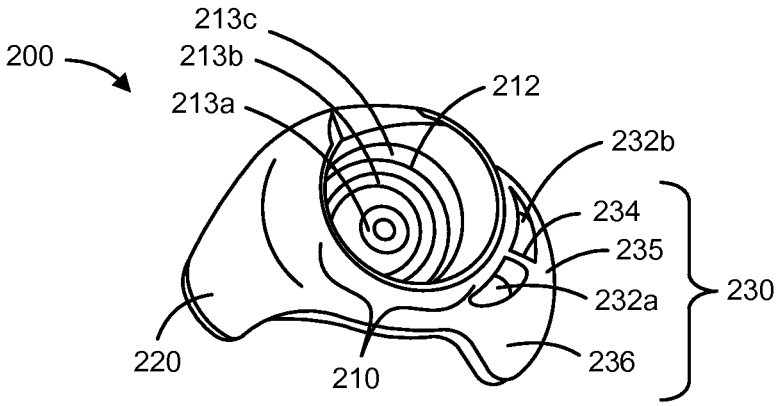
FIGS. 2A-D show perspective and side views of an earmold.

The earmold described herein allows for fitting inside many different shapes of concha cavae while providing enough pressure to maintain the earmold inside the concha cavum during forceful and/or repetitive head movements. FIG. 2A shows a perspective view of a right-ear earmold 200 from the exterior side, in an inverted orientation (i.e., upside down with respect to an upright person's ear). An earmold cavity 210 is configured to hold an earpiece that transmits sound. The earmold is made of a firm but flexible elastomeric material, such as silicon or rubber, that allows for the earmold to be mated with an earpiece inside the cavity. In some embodiments, the earmold may include an indentation or hole (e.g., shown as 422 in FIG. 4) that is contiguous with the cavity of the earmold, and is configured to mate with a tab on the earpiece. The tab-hole mating may aid in preventing the earmold from rotating around the earpiece and/or separating from the earpiece.

At the bottom of the cavity 210 is a thinned region 212. The thinned region depicted in FIG. 2A is circular in shape, although in some embodiments it may have other shapes, such as ovoid or polygonal (e.g. triangular, rectangular, pentagonal, hexagonal, etc.). The thickness of the thinned region 212 is sufficiently small to allow the earmold to be deformed slightly in one or more directions when inserted into a concha cavum. For example, the earmold may be deformed by force exerted by one or more of the ear structures including at least the anterior concha cavum, posterior concha cavum, superior concha cavum, and the inferior concha cavum. The circular ripples 213*a-c* seen on the thinned region are ornamental; the thinned region may be smooth in appearance in some embodiments, or may have other designs molded in. The thinned region may be about 0.1 mm to about 1 mm in thickness, whereas the remainder of the earmold may have a thickness of about 2 mm to about 4 mm in thickness. The earmold also includes a sound channel output port 220 that is hollow and allows sound from the earpiece to be directed into the ear canal. When the earmold is inserted into the concha cavum, the sound channel points towards and is proximate the entrance of the ear canal, but does not enter the ear canal itself. In some embodiments, the thinned region may not be uniformly thin, but may be interspersed by regions that are not thinned.

The earmold of FIG. 2A also includes a posterior region 230 that may include holes 232*a* and 232*b* and a rib or strut 234 that lies underneath a posterior arch 235. In some embodiments, the earmold may include two or more holes and one or more struts. The number, material, structure, and/or orientation of the struts between the holes may be modified to adjust the stiffness of the posterior arch 235 and change the compliance of the posterior arch 235, and thus the amount of force needed for the posterior concha cavum to deform the earmold. In some embodiments, the earmold may have one, two, three, four, or five struts. In addition, the length of the struts can be varied to adjust the amount of force needed for the posterior concha cavum to deform the earmold. Furthermore, the cross-sectional structure or material forming the struts may in some embodiments be configured for a particular amount (or differing amounts) of compliance. In some embodiments, the rib or strut 234 may extend straight from the main body of the earmold to the posterior arch 235.

When the earmold is inserted into the ear, force from the posterior concha cavum may press against the posterior arch of the earmold and may deform the ribs/struts 234 that lie underneath the arch 235. In other embodiments, the earmold may include no holes or struts in the posterior region 230, and the thickness of the posterior arch 235 or the whole posterior region 230 may permit or inhibit deformation of the earmold for a given amount of force. If sufficient force is exerted on the earmold by the posterior concha cavum, the earmold may deform near the thinned region 212 as well. The earmold also includes a fin or flange 236 emerging (with respect to ear position) from just above the posterior region 230. The fin or flange 236 may facilitate securing the earmold in the concha cavum. When the earmold is inserted in the concha cavum, the fin or flange 236 reaches partially into the concha cymba and presses against the crus of helix (see FIG. 1 for ear anatomy).

Figure 2B:
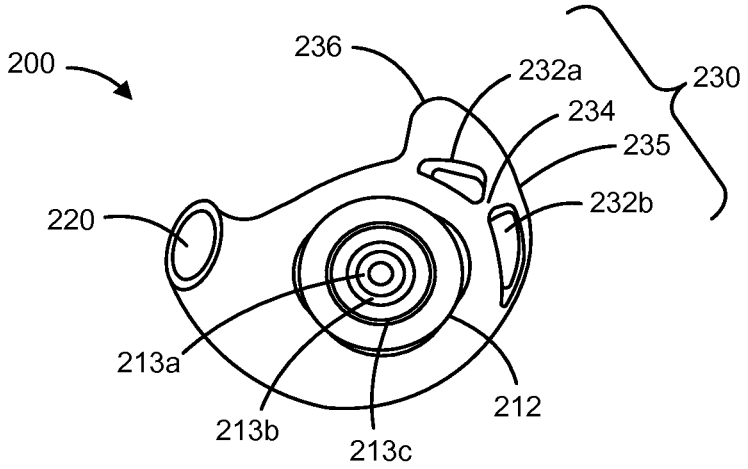

FIG. 2B shows a side view of the interior side of the earmold 200, with the thinned region 212, circular ripples 213*a-c*, sound channel 220, holes 232*a-b*, rib or strut(s) 234, posterior arch 230 and fin or flange 236.

Figure 2C:
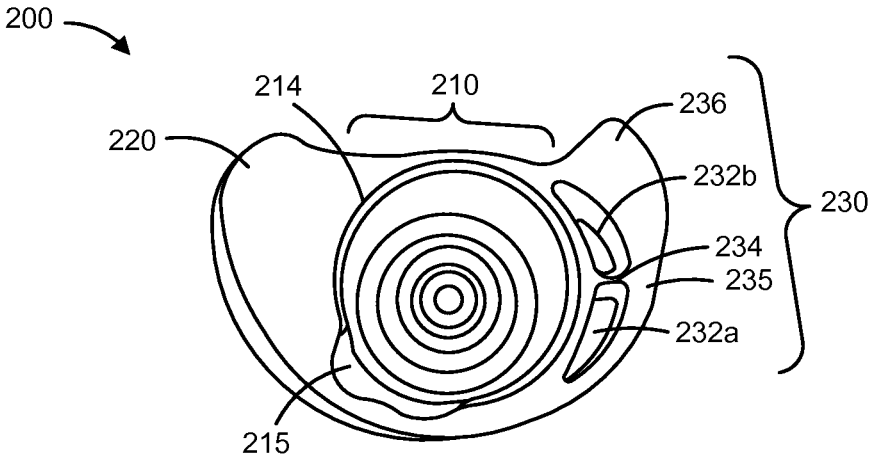
Figure 2D:
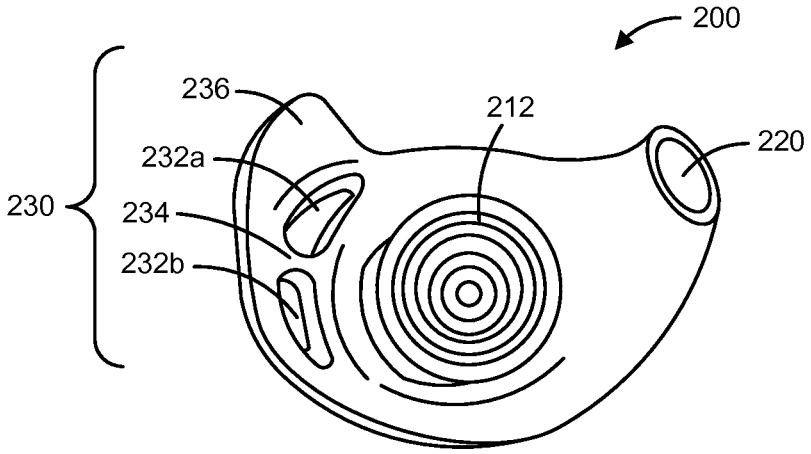

FIG. 2C depicts a side view of the exterior side of a left-ear earmold, rotated 180 degrees compared to FIG. 2A. Numbering is the same as for FIGS. 2A, 2B in referring to like members. The earmold cavity 210 has an exterior ridge 214, and in some embodiments may have a gap or cutout 215 that is configured to allow wires and/or part of the body of an earpiece to lie proximate the earmold. FIG. 2D is a side view of the interior side of the left-ear earmold 200.

Figure 3A:
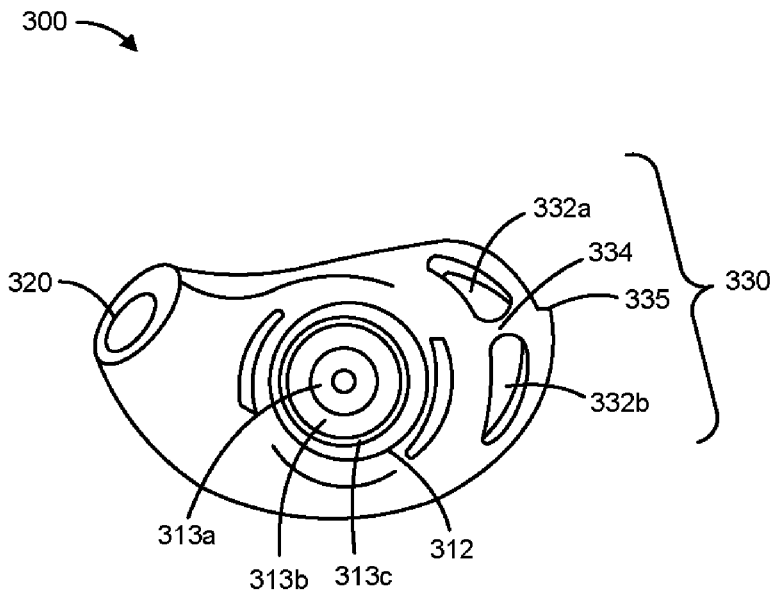
FIG. 3A shows a side view of an earmold lacking a fin.

In some embodiments of the present technology, the earmold does not have a fin or flange 236. FIG. 3A shows a side view of an interior side of a right-ear earmold 300 that lacks a fin emerging from the posterior arch 335 as shown. Similar to FIGS. 2A-2D, the embodiment depicted in FIG. 3A also includes a thinned region 312, circular ripples 313*a-c*, a sound channel output port 320, and posterior region 330. The posterior region 330 includes holes 332*a-b* separated by a rib 334 and having a posterior arch that frames the holes 332*a-b* and rib 334.

Figure 3B:
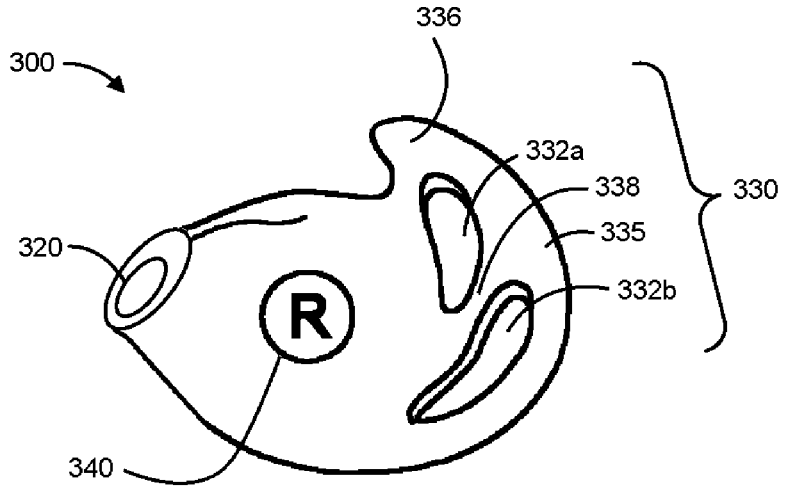
FIG. 3B shows a side view of an earmold having a fin and a curved rib.

FIG. 3B similarly shows the interior side of a right-ear earmold 300. However, as shown in the illustrated embodiment the strut or rib 338 may extend tangentially from the main body to the posterior arch 335, the strut or rib 338 the angle of the strut/rib providing and additional degree of movement for the posterior arch 335, and providing a more comfortable fit. FIG. 3B also shows a variation of a fin 336, that is integrated with the posterior arch 335. An imprint 340 indicates to the user which ear the earmold is intended for. In the illustrated example, the "R" indicates to the user that the earmold is for the right ear. Although the imprint is shown at a central portion of the an inner portion of the earmold, it may be provided at a different location.

Figure 4:
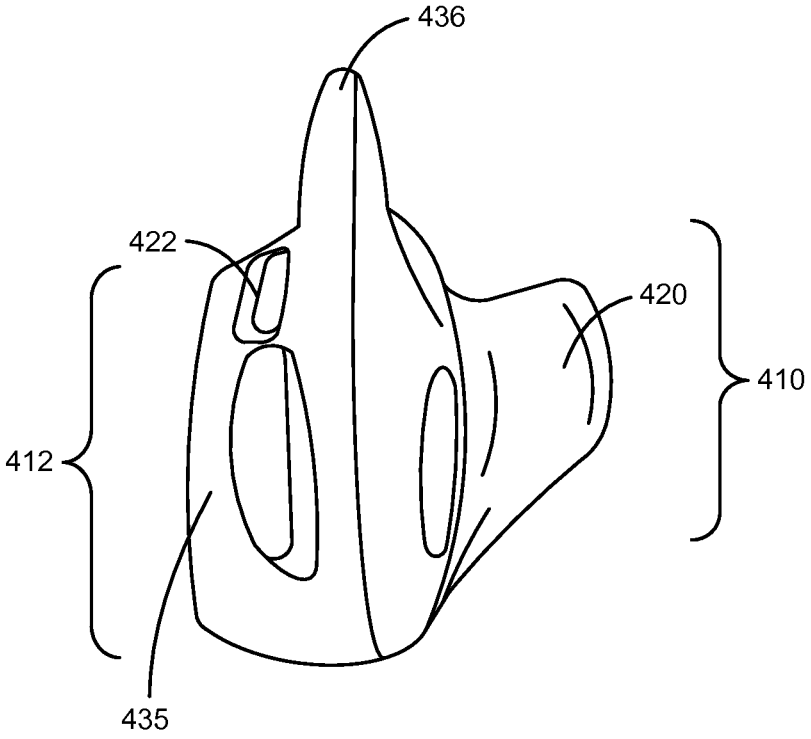
FIG. 4 shows a posterior side view of an earmold having a fin and securing aperture.

FIG. 4 depicts an embodiment of an earmold 400 that includes a flange 436 (similar to fin or flange 236 of FIG. 2). More specifically, FIG. 4 shows a rear side view of the earmold, facing the posterior arch 435, and shows the fin/flange 436 and sound channel 420 relative to the interior side 410 (the side inserted into the concha cavum of the ear) and exterior side 412 of the earmold 400. In some embodiments of the earmold, the fin or flange 436 may be offset (not shown), lying closer to the exterior side of the earmold to accommodate a portion of the crus of helix when the earmold is inserted into the concha cavum. This relieves pressure on the crus of helix from the fin or flange 436, while still allowing the fin/flange itself to rest inside the concha cymba. In some embodiments, the fin/flange may be curved (convex) outward to reduce pressure on the crus of helix. FIG. 4 also shows a securing aperture 422 that may receive and mate with a tab on an earpiece inserted into the earmold to, for example, prevent unwanted movement of the earmold with respect to the earpiece. In some embodiments, the earmold may have a securing indentation, instead of a securing hole, that is contiguous with the cavity of the earmold, and aids in preventing the earmold from rotating around the earpiece and/or separating from the earpiece.

Figure 5A:
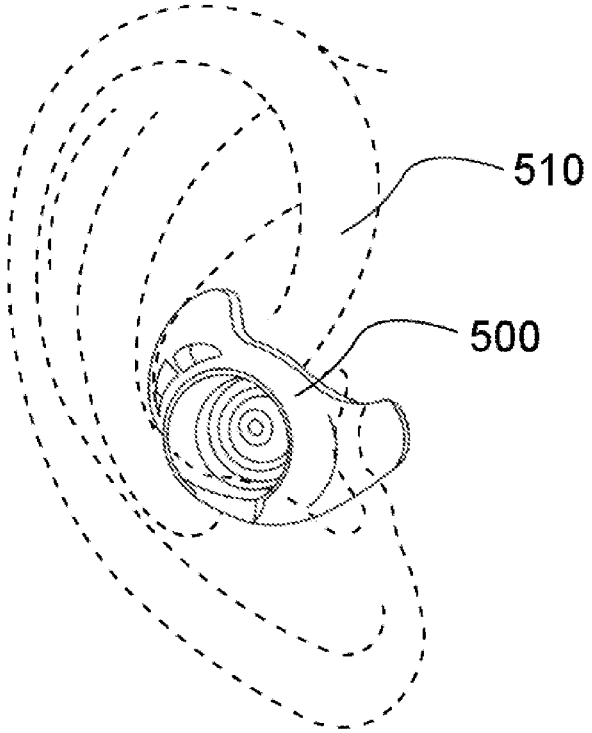
FIG. 5A shows a side view of an earmold as it may fit in a wearer's ear.
Figure 5B:
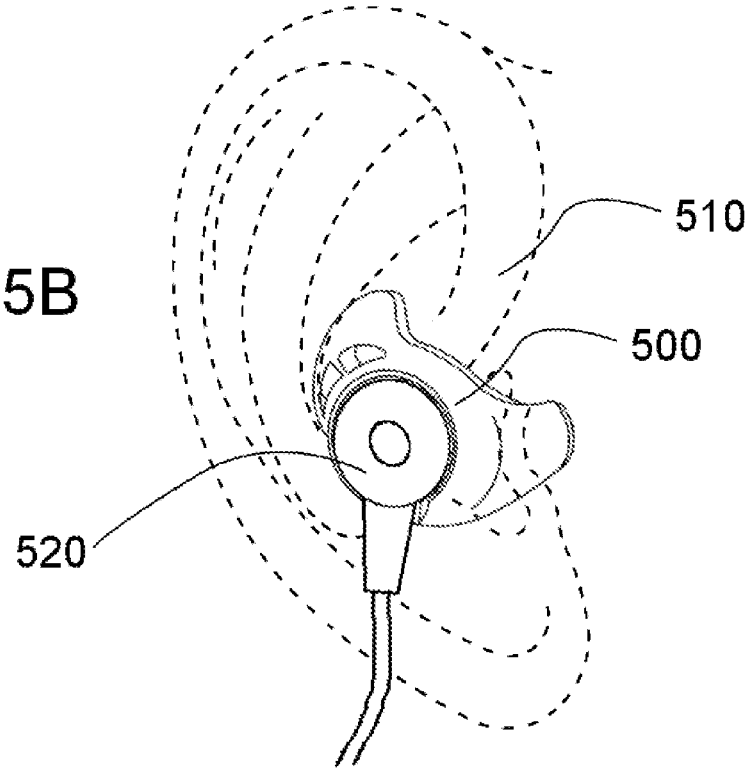
FIG. 5B shows a side view of an earpiece together with an earmold as it may fit in a wearer's ear.

FIG. 5A illustrates an embodiment in which an earmold 500 is placed in a wearer's ear 510. FIG. 5B goes slightly farther, illustrating an ear 510 having placed therein the earmold 500 together with an associated earpiece 520.

The earmold described above may be a molded cover made of an elastomeric material, or it may be overmolded directly on or to the surface of an earpiece.

The above-described figures may depict exemplary configurations for an apparatus of the disclosure, which is done to aid in understanding the features and functionality that can be included in the earmolds described herein. The apparatus is not restricted to the illustrated architectures or configurations, but can be implemented using a variety of alternative architectures and configurations. Additionally, although the apparatus is described above in terms of various exemplary embodiments and implementations, it should be understood that the various features and functionality described in one or more of the individual embodiments with which they are described, but instead can be applied, alone or in some combination, to one or more of the other embodiments of the disclosure, whether or not such embodiments are described and whether or not such features are presented as being a part of a described embodiment. Thus the breadth and scope of the present disclosure, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read to mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. Additionally, where a range is set forth, the upper and lower limitations of the range are inclusive of all of the intermediary units therein.

The foregoing description is intended to illustrate but not to limit the scope of the disclosure, which is defined by the scope of the appended claims. Other embodiments are within the scope of the following claims.

What is claimed:

1. An earmold for transmitting sound from a headphone earpiece to an ear of a wearer, the earmold comprising: a main body having an exterior shaped to substantially correspond with the concha cavum of an ear, the main body having an earpiece cavity formed by at least one wall forming a perimeter of the earpiece cavity, an outermost extent of the wall forming an exterior ridge, the earpiece cavity shaped to accept corresponding portions of an earpiece having a sound transducer; a hollow sound channel extending from an inlet formed at the wall of the earpiece cavity to a sound channel output port disposed for proximity to a user ear canal at an inferior region of the concha cavum; and a posterior arch extending out from a side of the main body opposite the sound channel output port, the posterior arch configured to compress against an antihelix region of the concha cavum to maintain the earmold within the concha cavum, at least one hole formed in the posterior arch, the hole allowing deformity of the posterior arch against compression by the antihelix region of the concha cavum.

2. The earmold in accordance with claim 1, further comprising a back, thinned region in a mid-region of the main body, the thinned region formed across and covering an area defined by the perimeter, the thinned region joining an innermost extent of the at least one wall that forms the perimeter, the thinned region allowing the main body of the earpiece to deform against curvatures of the concha cavum to conform to the ear of the wearer.

3. The earmold in accordance with claim 1, further comprising at least one rib dividing the hole into multiple hole portions, the at least one rib connected between the posterior arch and the main body of the earmold.

4. The earmold in accordance with claim 1, further comprising a fin extending from the posterior arch of the earmold and formed to correspond with concha cymba region of the ear of the wearer.

5. The earmold in accordance with claim 4, wherein the fin is offset toward an exterior side of the earmold at the posterior arch.

6. The earmold according to claim 1, wherein the perimeter formed by the wall of the main body is circular.

7. The earmold according to claim 1, further comprising a gap in the exterior ridge of the wall of the main body, the gap formed to receive at least a wire extending from the earpiece.

8. The earmold according to claim 7, wherein the gap is formed to receive a wire guide portion of the earpiece integrally formed with and extending from the earpiece, a portion of the at least a wire being enclosed within the wire guide portion.

9. An earmold for fitting within a concha cavum of an ear, and for transmitting sound from a headphone, the earmold comprising: a main body having a shape configured to substantially correspond with the concha cavum of a human ear, the main body having a hollow sound channel therein, the hollow sound channel extending between an inlet and a sound channel output port, wherein the inlet is disposed at an earpiece cavity of the main body, the earpiece cavity for receiving the headphone, and the sound channel output port disposed at an exterior portion of the main body for being positioned proximate an inferior region of the concha cavum, a posterior arch extending out from a side of the earmold opposite the sound channel output port, the posterior arch formed to compress against an antihelix region of the concha cavum to maintain the earmold within the concha cavum of the ear, at least one hole formed in the posterior arch, the hole allowing deformity of the posterior arch against compression by the antihelix region of the concha cavum.

10. The earmold according to claim 9, further comprising at least one rib dividing the hole into multiple hole portions, the at least one rib connected between the posterior arch and the main body of the earmold.

11. The earmold according to claim 10, wherein the at least one rib is formed at a tangent to the main body of the earmold.

12. The earmold according to claim 9, wherein the at least one hole formed in the posterior arch is formed from a head side surface of the posterior arch through an outward-facing surface of the posterior arch.

13. The earmold according to claim 9, further comprising a fin extending upward from the posterior arch of the earmold and formed to correspond with concha cymba region of the ear of the wearer.

14. The earmold in accordance with claim 13, wherein the fin is offset toward an outward facing surface of the earmold at the posterior arch.

15. A headphone comprising:

an earpiece having one or more sound producing elements; and an earmold configured to fit within a concha cavum a of human ear, the earmold comprising:

a main body having an exterior shaped to substantially correspond with the concha cavum and having an earpiece cavity formed by a cavity floor and at least one wall that forms an interior perimeter of the earpiece cavity, an outward-facing extent of the wall, opposite the cavity floor, forming an exterior ridge, the earpiece cavity shaped to accept corresponding portions of the earpiece having the one or more sound producing elements;

a hollow sound channel extending between an inlet formed at the wall of the earpiece cavity and a sound channel output port disposed for proximity to a user's ear canal at an inferior region of the concha cavum, the hollow channel to transmit sound from at least one of the one or more sound producing elements to the user's ear canal; and a posterior arch extending out from a side of the main body opposite the sound channel output port, the posterior arch configured to compress against an antihelix region of the concha cavum to maintain the earmold within the concha cavum, at least one hole formed in the posterior arch, the hole allowing deformity of the posterior arch against compression by the antihelix region of the concha cavum.

16. The headphone in accordance with claim 15, wherein the earpiece includes one or more tabs extending from the earpiece for engagement with the main body of the earmold, and the earmold includes one or more indentations in the at least one wall of the main body, the indentations configured to respectively receive the one or more tabs of the earpiece to prevent the earmold from rotating around the earpiece.

17. The headphone according to claim 15, further comprising a gap in the exterior ridge of the wall of the main body, the gap formed to receive at least a wire extending from the earpiece.

18. The headphone according to claim 17, wherein the gap is formed to receive a wire guide portion of the earpiece integrally formed with and extending from the earpiece, a portion of the at least a wire being enclosed within the wire guide portion.

* * * * *

UNITED STATES PATENT AND TRADEMARK OFFICE

CERTIFICATE OF CORRECTION

PATENT NO. : 9,161,114 B2
APPLICATION NO. : 14/222536
DATED : October 13, 2015
INVENTOR(S) : Bone et al.

It is certified that error appears in the above-identified patent and that said Letters Patent is hereby corrected as shown below:

In the claims
Col. 6, line 33, claim 2: "earpiece" should be changed to --earmold--
Col. 6, line 42, claim 4: insert --a-- after "with" and before "concha"
Col. 7, line 20, claim 13: insert --a-- after "with" and before "concha"
Col. 7, line 21, claim 13: delete "of the wearer"

Signed and Sealed this
Second Day of August, 2016

Michelle K. Lee

Michelle K. Lee
*Director of the United States Patent and Trademark Office*